United States Patent [19]

Westergaard

[11] 4,346,850

[45] Aug. 31, 1982

[54] SHREDDING MACHINE INCORPORATING A TORQUE CUSHIONING ASSEMBLY

[75] Inventor: Carl Westergaard, Palatine, Ill.

[73] Assignee: Mitts & Merrill Inc., Saginaw, Mich.

[21] Appl. No.: 179,068

[22] Filed: Aug. 18, 1980

[51] Int. Cl.[3] ..... B02C 18/20

[52] U.S. Cl. ..... 241/36; 241/230; 74/411; 318/475

[58] Field of Search ..... 241/32, 36, 230; 74/411; 318/282, 475

[56] References Cited

U.S. PATENT DOCUMENTS

| | | | |
|---|---|---|---|
| 1,409,238 | 3/1922 | Punteney | 241/32 |
| 2,244,996 | 6/1941 | Laird | 241/32 |
| 3,880,361 | 4/1975 | Schwarz | 241/36 |

*Primary Examiner*—James M. Meister
*Attorney, Agent, or Firm*—Learman & McCulloch

[57] ABSTRACT

A shredding machine of the general type employed for comminuting difficult to shred material incorporates a torque cushioning device for the purpose of minimizing breakage of the comminuting teeth or knives of the apparatus when the teeth encounter metal or other objects which impose a torque overload on the rotating teeth. The drive motor is coupled to the shafts carrying the comminuting teeth by means of a drive transmission assembly such as a speed reducer box. The transmission assembly is shaft mounted upon the input shaft to the comminuter so that the casing of the transmission assembly can rotate relative to the fixed frame of the machine about the axis of its supporting shaft. An arm fixedly mounted upon the casing is biased by springs mounted upon the machine frame. Application of a torque overload to the comminuting shafts, as by the teeth engaging a hard metal object, produces a reaction tending to rotate the transmission casing relative to the frame, this rotation being resiliently resisted by the springs to cushion the impact on the teeth.

6 Claims, 3 Drawing Figures

SHREDDING MACHINE INCORPORATING A TORQUE CUSHIONING ASSEMBLY

In a preferred form of the invention, the coupling between the drive motor and input shaft of the transmission assembly is a resilient belt and pulley drive in which the relationship of the parallel axes of the motor shaft, transmission input shaft and comminuting drive shaft is such that rotation of the transmission casing relative to the frame occasioned by a torque overload causes the distance between the motor shaft and the transmission input shaft to be increased, the consequent stretching of the drive belts providing a further resilient force resisting such rotation.

BACKGROUND OF THE INVENTION

Shredding machines of the general type with which the present invention is concerned are well known, see for example Schwarz U.S. Pat. No. 3,880,361, which is incorporated herein by reference. Machines of this type are frequently used for shredding trash, sheet metal, automobile tires, etc. Typically, as shown in the Schwarz patent, a pair of parallel rotatable knife carrying shafts have sets of knives or cutters axially interleaved which are rotated in opposite directions to shred material which is gravitationally fed to the knives. Because the material being shredded may, in many instances, include pieces of metal or other objects which exert substantial resistance to the shredding action of the knives, many of such machines are provided with a torque responsive control which will reverse the direction of rotation of the drive motor when a torque overload is sensed at the comminuting shafts. This reversal of direction of rotation of the comminuting shafts will disengage the teeth from the offending object and reposition the object by virtue of the reversal of the direction of rotation. Controls of this type are disclosed in the aforementioned patent.

The problem encountered with such controls is that the torque responsive, drive reversing control requires a finit time period to accomplish the drive reversal. We have determined that, when the comminuting teeth encounter an extremely hard object, the time delay between the sensing of the torque overload and the reversal of direction of rotation of the comminuting shafts may be too long to prevent the knives or teeth on the comminuter from being broken off or damaged.

The present invention is especially directed to a solution to this latter problem. U.S. Pat. Nos. 1,409,238, 2,273,772, 2,597,635, 3,423,033, 3,478,972, 3,845,906 and 3,918,648, disclose various mechanisms which have attempted to solve similar problems but are not deemed suited to the purposes of the applicant here. In the present instance, the casing of a drive transmission component in the drive line is so mounted that a torque overload on the comminuting shafts reacts to bodily rotate this casing relative to the fixed frame of the machine. Cushioning devices are provided to resiliently resist this movement of the casing, thus cushioning the impact and absorbing the resistance applied to the knives for a period sufficient to enable the drive to be reversed before damage to the knives occurs.

SUMMARY OF A PREFERRED FORM OF THE INVENTION

In one form of the present invention, a drive motor and a hopper, having a pair of counter-rotating knife carrying comminuting shafts located at the bottom of the hopper, are mounted in spaced relationship upon a fixed frame with the motor shaft disposed in parallel relationship to the two comminuting shafts. The two comminuting shafts are geared to a single drive shaft which projects from the hopper into the casing of a gear reduction box located between the drive motor and the hopper. A belt and pulley coupling couples the drive motor shaft to a second shaft which projects from the reduction gear housing at a location offset to one side of both the motor shaft and the comminuter input shaft. The casing of the gear reduction box is not directly attached to the fixed frame of the apparatus. An arm fixedly secured to the gear box casing projects from the casing and is formed with one or more openings through which elongate bolts fixedly secured to the machine frame freely project. Each such bolt carries a pair of opposed compression springs which engage opposite sides of the arm.

Due to the offset relationship between the two shafts which project from the gear box casing, these shafts being positively coupled to each other by gearing within the gear box, an overload applied to the comminuting shafts will generate a reaction on the comminuting input shaft which is transmitted from that shaft through the gearing to the offset shaft in the casing, thus causing the casing to tend to rotate relative to the fixed frame about the axis of the comminuting input shaft. Such rotation of the gearbox casing is resiliently resisted by the compression springs engaged between the machine frame and the arm on the gearbox. This cushioning action reduces the impact and stress applied to a knife on the comminuting shafts in the event the knife engages a tough piece of metal.

Other objects and features of the invention will become apparent by reference to the following specification and to the drawings.

IN THE DRAWINGS

Figure 1:
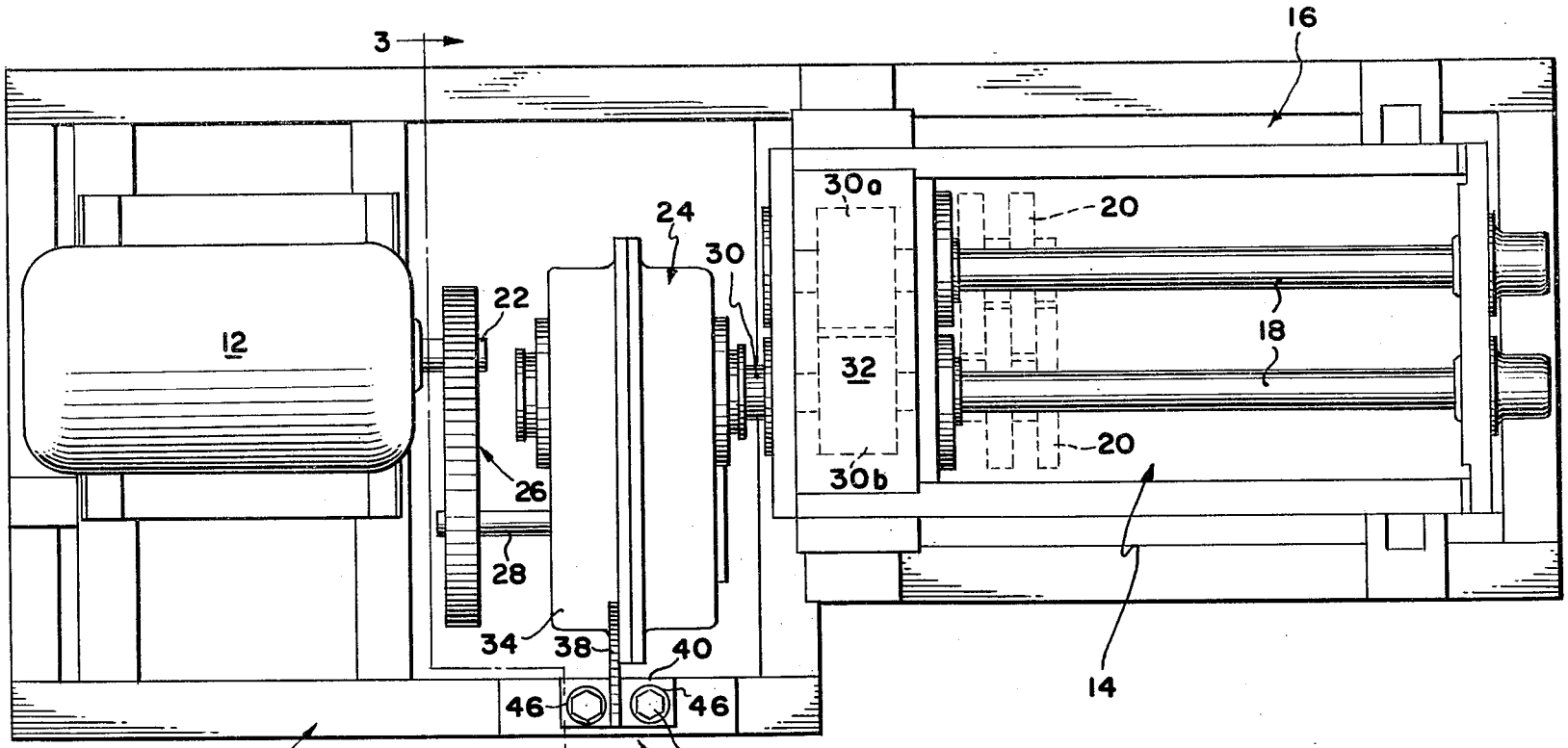
FIG. 1 is a top plan view of a shredding apparatus embodying the present invention.
Figure 2:
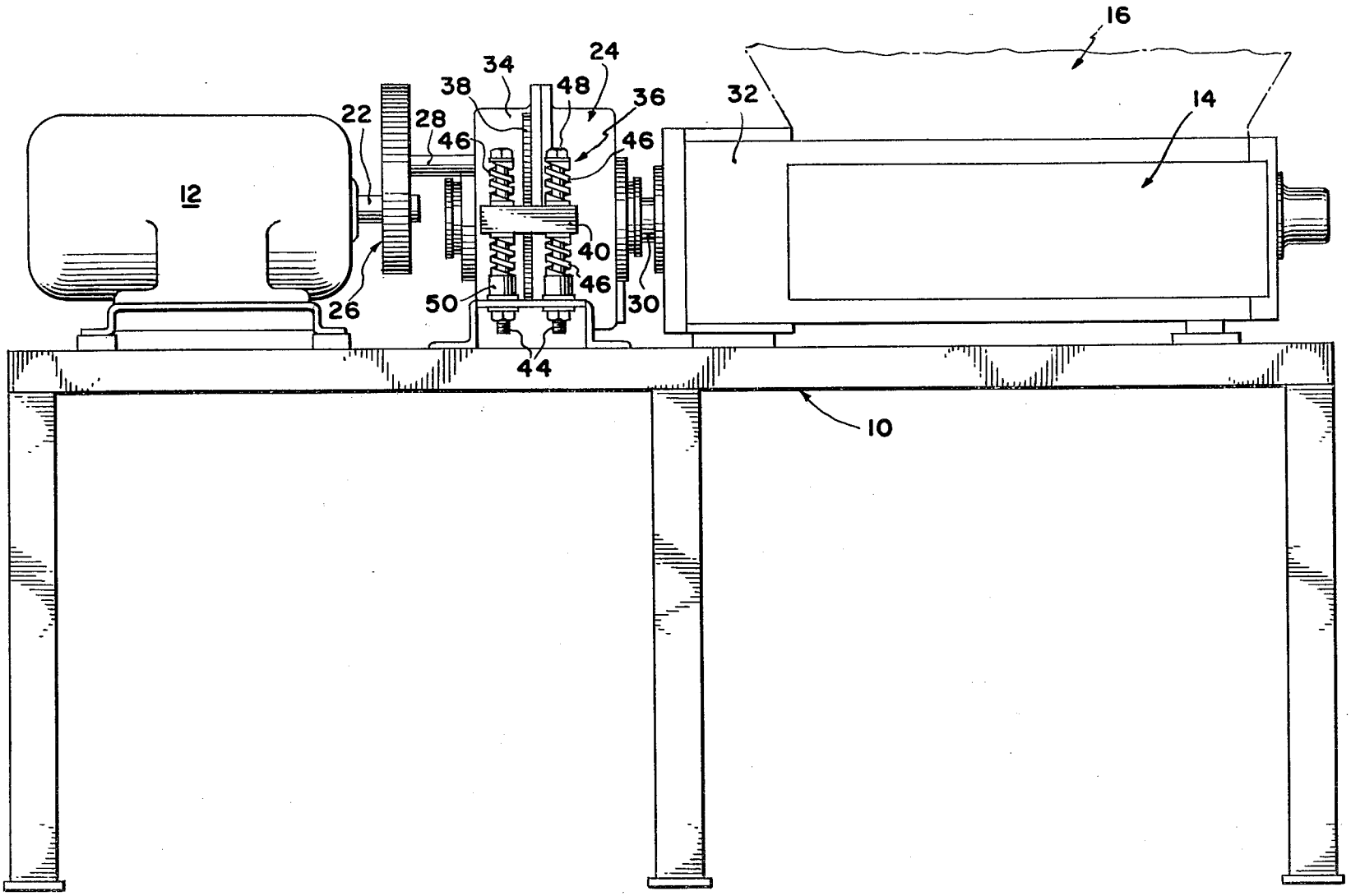
FIG. 2 is a side elevational view of the apparatus of FIG. 1.

Referring first to FIGS. 1 and 2, an apparatus embodying the present invention is shown as including a fixed frame designated generally 10 having a drive motor 12 fixedly mounted on one end. At the opposite end of frame 10, a shredder of the type disclosed in U.S. Pat. No. 3,880,361 and designated generally 14, is fixedly mounted. Shredder 14 includes an open topped (and open bottomed) hopper 16 within which a pair of parallel comminuting shafts 18 are rotatably mounted and coupled to each other by gears **30*a* and 30*b*, so that the two shafts are constrained to rotate in opposite directions. Each shaft 18 carries a series of rotary knives 20, the knives of the respective shafts being axially interleaved with each other so that, as viewed in FIG. 1, the space between the two shafts 18 presents a substantially solid array of knives. Further details of a typical knife arrangement are shown in U.S. Pat. No. 3,880,361. In a shredding operation, material is dropped into the hopper and the two shafts 18 are driven in rotation in a direction such that the portions of the rotary knives located above the axes of shafts 18** are driven toward one another. Material is thus urged by the rotating knives toward the space between the two shafts and driven downwardly through the space, being sheared or shredded by the knives as it passes into engagement with them.

Drive motor 12 is employed to drive shafts 18 in rotation, the rotation of drive motor shaft 22 being transmitted to a reduction gear assembly or casing 24 via a belt and pulley coupling 26 which drives the input shaft 28 of reduction gear 24 in rotation. The output shaft 30 of reduction gear 24 is rotatively journaled in a housing 32 located at one end of hopper 14, rotation of shaft 30 being transmitted by gear, such as disclosed in U.S. Pat. No. 3,880,361, within housing 32 to shafts 18 in a well-known manner to achieve the desired counter-rotation of shafts 18.

Reduction gear box 24 is not mounted directly upon frame 10, but instead is supported from the frame primarily by shaft 30. Casing 34 of gear box 24 would thus normally be free to rotate, relative to frame 10, freely about the axis of shaft 30. Casing 34 is restrained against such rotation by a cushioning spring assembly designated generally 36, and best shown in FIG. 3.

Figure 3:
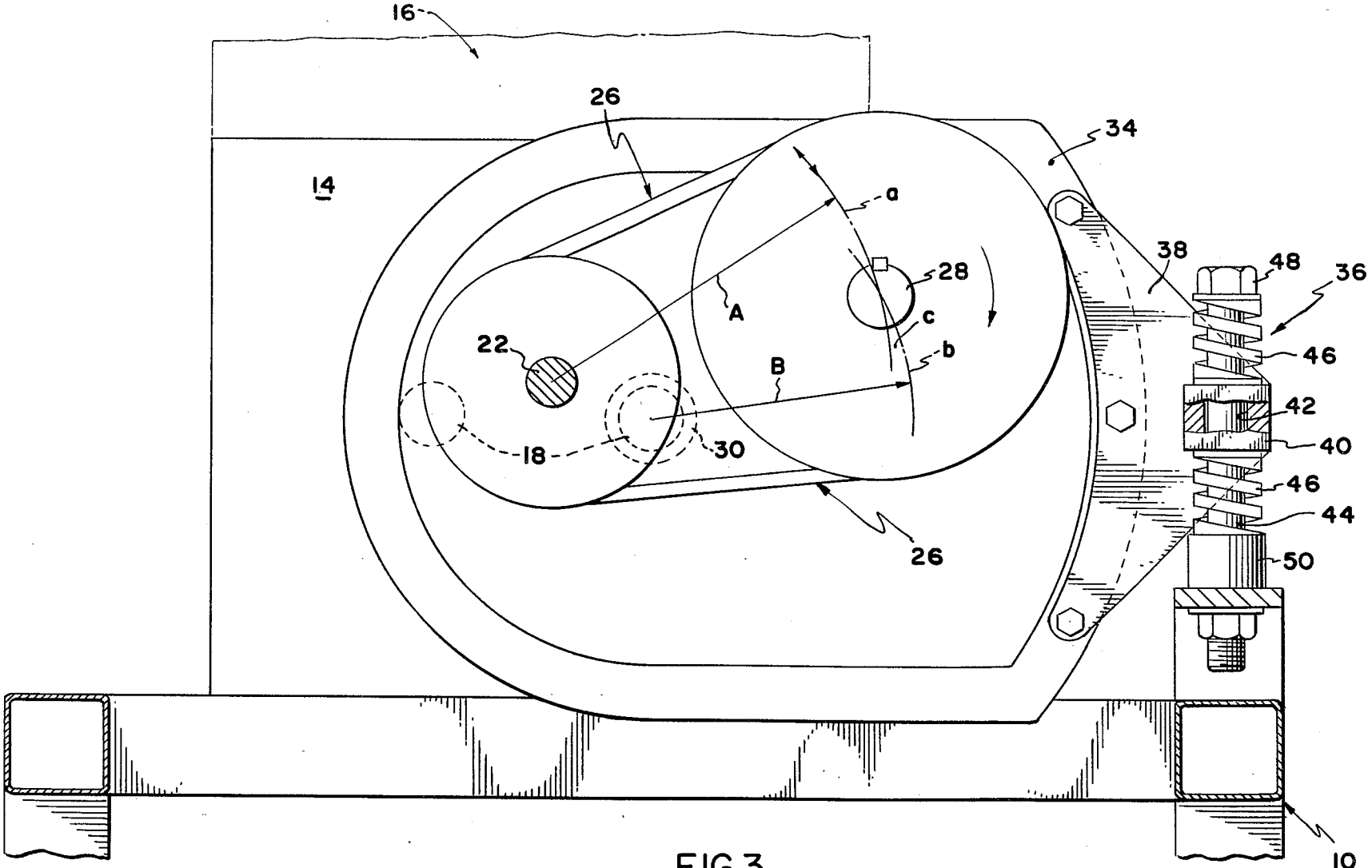
FIG. 3 is a detail cross sectional view taken on the line 3—3 of FIG. 1.

Referring to FIG. 3, it is seen that a plate 38 is fixedly bolted to casing 34 to form an armlike projection from the casing. Fixed lugs 40 mounted on arm 38 are bored as at 42 to freely receive one or more bolts 44 which are fixedly located at one end upon frame 10. A pair of compression springs 46 are loosely received on each bolt 44, one spring 46 being engaged between the head 48 of the bolt and the upper surface of lug 40, while the second spring 46 is engaged between the lug 40 and a spacer 50 on frame 10.

The gearing within gearbox 24 is such that, when the comminuting shafts 18 are being driven in their normal comminuting directions (the portions of knives 20 above shafts 18 moving toward each other), input shaft 28 of reduction gearbox 24 is driving in a clockwise direction as viewed in FIG. 3. It may be assumed that a gear on shaft 28 meshes with another gear within gearbox 24 at a point to the left of the axis of shaft 28 as viewed in FIG. 3. Thus, inasmuch as shaft 28 is journaled within casing 34 of gearbox 24, which is in turn supported upon shaft 30, a sudden force tending to slow or stop the normal rotation of shaft 30 reacts against the gear on shaft 28 in a manner tending to move shaft 28 downwardly as viewed in FIG. 3. Downward movement of shaft 28 in turn rotates casing 34 in a clockwise direction about the axis of shaft 30, this rotative movement of casing 34 being resisted by the lower spring 46 of cushioning device 36. Thus, in the event the rotating knives on comminuting shafts 18 should engage a hard solid piece of metal which cannot be immediately sheared, the impact of the knives on this object exerts a braking action on shaft 30 and the back torque is cushioned by the lower springs 46 in the manner described above. This load cushioning occurs automatically to protect the knives 20 before the reversing system disclosed in U.S. Pat. No. 3,880,361 operates to reverse the direction of drive of motor 12 and reposition the piece of metal. Upper springs 46 minimize any rebound reaction when the piece of metal repositions.

To further assist the cushioning action, the geometrical relationship of shafts 22, 28 and 30 as viewed in FIG. 3 is such that the downward movement of shaft 28 described above acts to attempt to increase the distance between shafts 22 and 28, thus attempting to stretch the slightly stretchable hard rubber fabric belts of belt and pulley drive 26. Both of shafts 22 and 30 rotate about fixed axes relative to the machine frame, while the axis of shaft 28 is floating. Under normal belt tension, the radial distance A between shafts 22 and 28 is as indicated, thus shaft 28 would tend to move along an arc a centered on shaft 22. The location of shaft 30 (fixed with respect to the machine frame) to shafts 22 and 28 is such that movement of shaft 28 relative to shaft 30 must take place along the arc b which is located at a fixed radial distance B from shaft 30, radius B being fixed in that both shafts 30 and 28 are journaled within casing 34. Thus, if shaft 28 moves downwardly, it is constrained to move along arc b and such downward movement must increase the distance between shafts 22 and 28 because of the divergence of the arcs a and b as indicated at c in FIG. 3.

While one embodiment of the invention has been described, it will be apparent to those skilled in the art that the disclosed embodiment may be modified. Therefore, the foregoing description is to be considered exemplary rather than limiting, and the true scope of the invention is that defined in the following claims.

I claim:

1. In a shredding machine having a frame defining a shredding chamber, rotatable comminuting mechanism having knife means mounted in said chamber and operable when rotated to shred material fed into said chamber, drive means including a reversible drive motor operatively coupled to said comminuting means, and torque responsive means for reversing the direction of rotation of said drive motor in response to an overload on said comminuting means; the improvement wherein said drive means comprises drive transmission means drivingly coupling said motor to said comminuting means, said transmission means including a casing, a first rotatable shaft projecting from said casing, said first shaft being rotatably journaled in said frame and coupled to said comminuting means to constitute the drive shaft therefor, and resilient means mounted on said frame and engaged with said casing for resiliently resisting rotative movement of said casing bodily relative to said frame about the axis of said first shaft.

2. The invention defined in claim 1 wherein said resilient means comprises a pair of axially opposed compression springs having their remote ends fixedly located with respect to said frame, and an arm fixedly mounted on said casing and engaged between the adjacent ends of said springs.

3. The invention defined in claim 1 wherein said transmission means comprises a second shaft rotatably mounted in and projecting from said casing in spaced parallel relationship to said first shaft, gear means in said casing establishing a positive drive coupling between said first and second shafts, and means drivingly coupling said motor to said second shaft.

4. The invention defined in claim 3 wherein said means coupling said motor to said second shaft comprises a slightly stretchable belt and pulley drive, the axes of rotation of said motor and said first shaft being located relative to said second shaft such that rotation of said casing induced by an overload on said comminuting means acts to increase the distance between the pulleys of said belt and pulley drive.

5. A shredding system having a housing defining a shredding chamber; rotatable comminuting mechanism mounted in said chamber and operable when rotated to shred material fed into said chamber; drive means including a drive motor operatively coupled to said comminuting means; said drive means including drive transmission means drivingly coupling said motor to said comminuting means; said transmission means including a casing with input shaft means drivingly coupled to said motor; the casing having an output fixed to said rotatable comminuting means such that it is supported thereby; and resilient means for resiliently resisting rotative movement of said casing bodily relative to said frame when an impediment interrupts rotation of said comminuting means.

6. The system of claim 5 wherein said comminuting mechanism includes a pair of shafts with shredding knives thereon which are driven in opposite directions by said output.

* * * * *